US006470897B1

(12) United States Patent
Jung et al.

(10) Patent No.: US 6,470,897 B1
(45) Date of Patent: Oct. 29, 2002

(54) MASCARA BRUSH FOR MAKING UP EYELASHES

(75) Inventors: Hae-won Jung, Inchon-si; Yeong Jin Choi, Yongin-si; Sung Ho Lee, Kunpo-si, all of (KR)

(73) Assignee: Pacific Corporation (KR)

( * ) Notice: Subject to any disclaimer, the term of this patent is extended or adjusted under 35 U.S.C. 154(b) by 0 days.

(21) Appl. No.: 09/828,522

(22) Filed: Apr. 6, 2001

(51) Int. Cl.[7] ..... A45D 40/26; A45D 44/18; A46B 11/00

(52) U.S. Cl. ..... 132/218; 132/313; 15/206; 401/129

(58) Field of Search ..... 132/218, 317, 132/318, 216, 320, 313; 15/206, 207.2, 160; 401/129, 122

(56) References Cited

U.S. PATENT DOCUMENTS 3,892,248 A 7/1975 Kingsford
4,586,520 A * 5/1986 Brittain ..... 132/218
4,861,179 A * 8/1989 Schrepf et al. ..... 401/129
4,898,193 A * 2/1990 Gueret ..... 132/218
5,063,947 A * 11/1991 Gueret ..... 132/218
5,197,497 A * 3/1993 Gueret ..... 132/218
5,238,011 A * 8/1993 Gueret ..... 132/218
5,370,141 A * 12/1994 Gueret ..... 132/218

* cited by examiner

*Primary Examiner*—John J. Wilson
*Assistant Examiner*—Robyn Kieu Doan

(57) ABSTRACT

Disclosed is a mascara brush for making up eyelashes, especially suitable for the Orientals whose eyelashes are shorter and downwardly curved. The mascara brush according to the present invention includes a spirally twisted wire core at the center thereof; and a plurality of bristles, each being fitted into the wire core at one end thereof and being outwardly extended at the other end. The bristles are 5 mils to 6 mils thick and distributed at the wire core to be installed in 30 to 40 numbers per turn of the spirally twisted wire core. A section through the mascara brush is of a triangular shape. Ridges of 1.7 mm to 2 mm wide are formed at vertexes of the triangular section. A distance A from a bottom to each ridge of the triangular section through the mascara brush is in the range of 5.5 mm to 6 mm.

1 Claim, 6 Drawing Sheets

MASCARA BRUSH FOR MAKING UP EYELASHES

BACKGROUND OF THE INVENTION

1. Field of the Invention

The present invention generally relates to a mascara brush for making up eyelashes, and more particularly to a mascara brush suitable for making up eyelashes of the Orientals.

2. Description of the Related Art

Mascara brushes are usually used for making up eyelashes. FIG.7 is a schematic view of a conventional mascara brush 101. The mascara brush 101 is manufactured in such a way that bristles of a predetermined length are clamped between two spirally intertwisted wire cores. FIG. 8 is a sectional view of the conventional mascara brush 101. As shown in FIG. 8, the conventional mascara brush 101 has a circular shaped section thereof.

Mascara application is performed by coating the mascara brush 101 with mascara filled in a mascara container and upwardly combing the eyelashes with the conventional mascara brush to retain the eyelashes being rolled up.

Since the conventional mascara brush 101 is manufactured to have such a circular profile, mascara is applied to the eyelashes before the bristles of the mascara brush sufficiently go into spaces between the eyelashes. As a consequence, the conventional approach causes air bubbles (air voids) or mascara aggregation as well as failing to obtain a uniform transfer of the mascara to the eyelashes.

Once the air bubbles are generated or the mascara is clotted as above, the eyelashes are not rolled up and look stained, rather giving an unwelcome look to others.

Further, if the eyelashes with the mascara aggregation are exposed to the wind, the mascara may be separated from the eyelashes and go into a user's eyes, thereby causing a visual obstruction, and if the mascara is even dropped onto her skin, a dermal trouble may be incurred.

To overcome the aforementioned shortcomings of the conventional mascara brush, U.S. Pat. No. 4,586,520 suggests a mascara brush, wherein bristles of different lengths are crossly distributed on a wire core, so that delivery of mascara is ensured in a uniform level and mascara aggregation is also prevented.

In the meantime, a mascara applicator having a substantially triangular or a polygonal section is shown in U.S. Pat. No. 3,892,248.

In addition, a mascara brush of a polygonal section (bivalved, triangular, tetragonal, pentagonal, or hexagonal shape) is disclosed in U.S. Pat. No. 4,898,193. The above brushes have reentrant surfaces between respective corners. In view of the reentrant surfaces of the brushes, sufficient amount of mascara can be transferred on the brushes and the mascara aggregation does not happen during a user's application of the mascara onto her eyelashes.

The above mascara brushes, however, are suitable in use for Westerners but not for the Orientals since Westerners'eyelashes are relatively longer and have a roll-up shape by nature. With thicker bristles, a larger section, and wider ridges, the mascara brushes are rather inconvenient for the Orientals, whose eyelashes are shorter and downwardly curved. Additionally, the mascara brushes have another drawback that mascara may be applied thereto too much due to the reentrant surfaces.

According to a thesis issued in 1991 on J. Soc. Cosmet. Chem. Japan. Vol. 24. No. 3 by Japanese Hiroko Hoshiya, Yasuyuki Yamamoto, and Massashi Fujii, entitled "Good Choice of Mascara for Your Eyes and Lashes", eyelashes of the Japanese are 6 mm long on the average, but 4 mm, if short. The Orientals have been found to have much shorter eyelashes than Westerners. Therefore, it is needed to develop a mascara brush suitable for the Orientals including the Koreans having similar physical conditions to the Japanese.

SUMMARY OF THE INVENTION

It is, therefore, an object of the present invention to provide a mascara brush for making up eyelashes, which can obviate disadvantages of conventional mascara brushes.

It is another object of the present invention to provide a mascara brush for making up eyelashes suitable for the Orientals whose eyelashes are shorter and downwardly curved.

It is further another object of the present invention to provide a mascara brush for making up eyelashes, which can minimize troublesomeness applied to eyes during making up the eyelashes.

It is still another object of the present invention to provide a mascara brush for making up eyelashes, which can achieve an excellent application of mascara without incurring mascara aggregation by making bristles of the mascara brush smoothly going into spaces between the respective eyelashes.

To achieve the above objects, there is provided a mascara brush for making up eyelashes according to the present invention. The mascara brush is characterized in having a triangular shape in cross-section and making ridges of a predetermined width being formed at vertexes of the triangular section.

To be specific, the mascara brush according to the present invention comprises a spirally twisted wire core at the center thereof and a plurality of bristles, each being fitted into the wire core at one end thereof and being outwardly extended at the other end thereof. The bristles are 5 mils~6 mils thick and distributed on the wire core to be installed in 30 to 40 numbers per turn of the spirally twisted wire core.

The section of the mascara brush is a triangular shape, ridges of 1.7 mm to 2 mm wide are formed on the vertexes of the triangular section, and a distance from the a bottom to each ridge of the triangular section of the mascara brush ranges anywhere from 5.5 mm to 6 mm long.

BRIEF DESCRIPTION OF THE DRAWINGS

The above and other objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
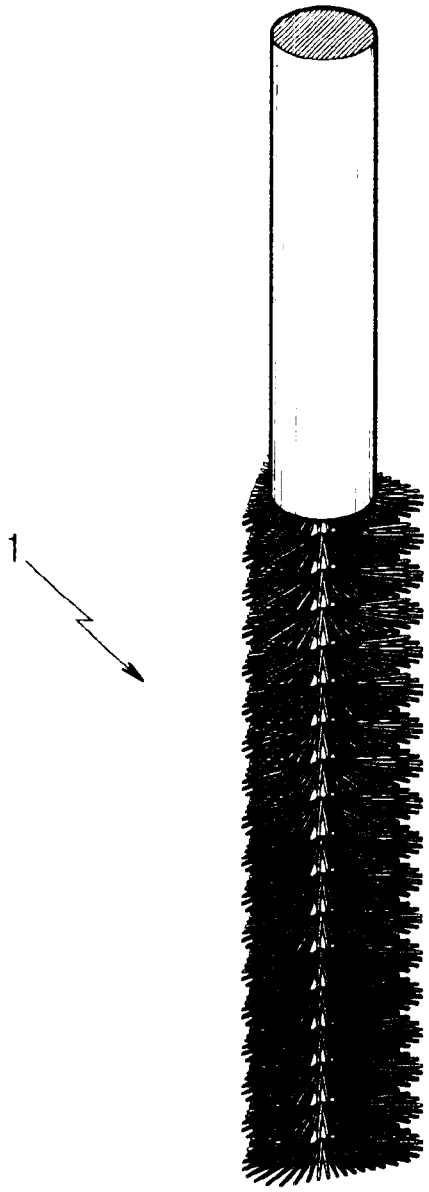
FIG. 1 is a cross view of a mascara brush according to the present invention.
Figure 2:
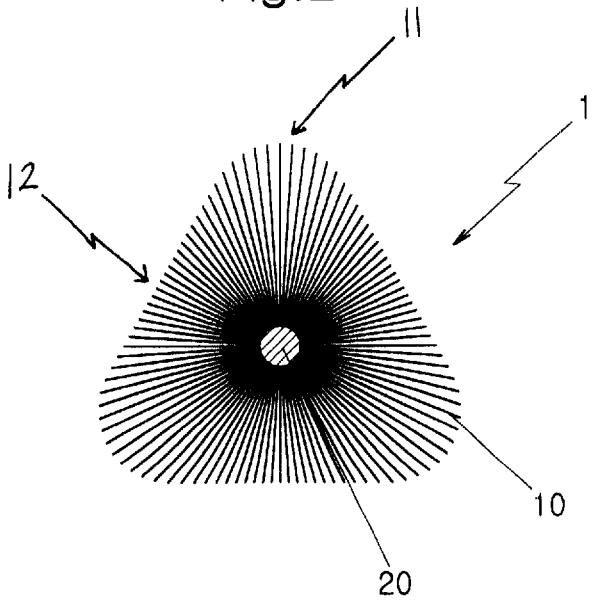
FIG. 2 is a sectional view of the mascara brush according to the present invention.
Figure 3:
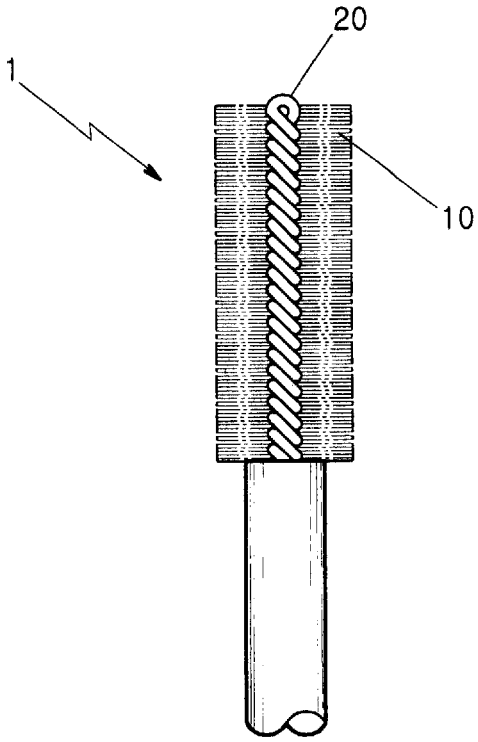
FIG. 3 is a perspective view of the mascara brush according to the present invention.

FIG. 1 is a schematic cross view of a mascara brush 1 according to the present invention. FIG. 2 is a sectional view of the mascara brush 1 according to the present invention. A spirally twisted wire core 20 is arranged at the center of the mascara brush 1. A plurality of bristles 10 define the contour of the mascara brush 1, with each bristle being fitted into the wire core 20 at one end thereof. FIG. 3 is a perspective view of the mascara brush 1 according to the present invention. Referring to FIG. 3, the number of the bristles 10 distributed on the wire core of the mascara brush 1 amounts to 30 to 40 numbers per turn of the wire core 20.

The bristles 10 comprised in the mascara brush 1 of the present invention have a thickness ranging from 5 mils to 6 mils, which is suitable for the Orientals including the Koreans having shorter eyelashes of approximately 4 mm to 6 mm, and further have soft and flexible properties. Here, 1 mil comes to 1/1000 inches.

Figure 4A:
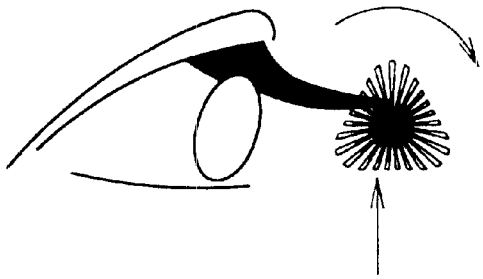
FIG. 4*a* to FIG. 4*c* are schematic views illustrating the state where the mascara brush according to the present invention is used.
Figure 4B:
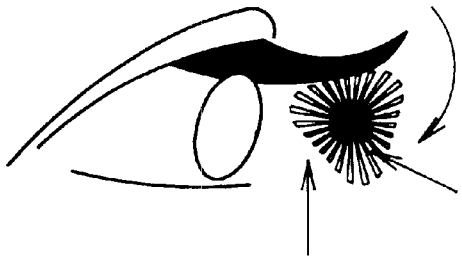
Figure 4C:
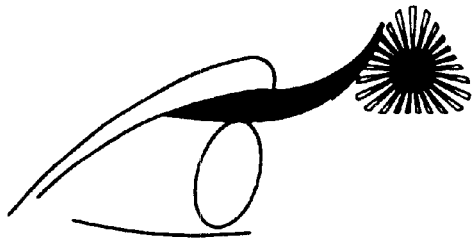

As drawn in FIG. 2, the mascara brush 1 of the present invention has a triangular shape in cross-section. In the triangular section of the mascara brush 1 according to the present invention, ridges 11 of a predetermined width are arranged at vertexes of the triangular section. Thus, when the eyelashes are combed by means of the mascara brush 1 of the present invention, the eyelashes are evenly combed as well as surfaces in contact with the eyelashes are reduced. FIG. 4*a* to FIG. 4*c* are schematic views illustrating the state where the eyelashes are combed with the mascara brush 1 of the present invention.

The ridges 11 arranged at the vertexes of the triangular section through the mascara brush 1 in accordance with the present invention have a width ranging from 1.7 mm to 2 mm. A distance A extending from a bottom 12 of the triangular section to each ridge 11 has a length ranging from 5.5 mm to 6 mm.

Mascara is applied onto the mascara brush of the present invention for the purpose of eyelash make-up. If the eyelashes are combed with the mascara brush 1 of the present invention, the bristles 10 go well into spaces between the respective eyelashes and accordingly the mascara transferred to the bristles 10 are well applied onto the eyelashes, since the mascara brush of the present invention has the triangular shaped section and the ridges 11 are arranged at the vertexes of the triangular section.

In particular, the mascara brush of the present invention can permit the mascara to be applied onto the eyelashes without incurring any mascara aggregation and the eyelashes to be rolled up in a clean and beautiful manner, since the mascara is mainly applied to the bottom 12 of the mascara brush 1 and the ridges 11 implements a certain combing function.

The mascara brush of the present invention is suitable for the Orientals having the eyelashes of 4 mm to 6 mm long, since the distance between the wire core and the bottom 12 is approximately 1.8 mm to 2 mm long and the distance between the wire core 20 and the ridges 11 is approximately 3.7 mm to 4 mm long. Specifically, the mascara brush 1 of the present invention can minimize troublesomeness imparted to the eyes due to the use of the mascara brush.

Survey of Preference

The following shows comparison results about women's preference, after a group of women make up their eyelashes with the mascara brush of the present invention and another group of women make up their eyelashes with the conventional mascara brush. It was conducted the questionnaire survey of the Oriental women in their twenties and thirties. The results are set out in the following Table 1 to Table 4.

TABLE 1

| | Comparison | Preference |
|---|---|---|
| Cross-sectional shape of brush | Circular shape | 7 |
| | Triangular shape | 10 |
| | Quadrangular shape | 3 |

Bristles of the brush used in the survey of Table 1 are 5 mils thick, respectively, and a distance A from a bottom to each ridge of the triangular brush is 5.5 mm long.

TABLE 2

| | Comparison | Preference |
|---|---|---|
| Width of ridge of triangular sectional brush | 1 mm | 6 |
| | 2 mm | 10 |
| | 3 mm | 40 |

Bristles of the triangular sectional brush used in the survey of Table 2 is 5 mils wide, respectively, and a distance A from a bottom to each ridge is 5 mm long.

TABLE 3

| | Comparison | Preference |
|---|---|---|
| Distance (A) between bottom and ridge of brush | 5.5 mm | 15 |
| | 8 mm | 5 |

In the triangular sectional brush used in the survey of Table 3, bristles are 5 mils thick and ridges are 2 mm wide, respectively.

TABLE 4

| | Comparison | Preference |
|---|---|---|
| Thickness of bristles | 5 mils | 19 |
| | 8 mils | 1 |

In the triangular sectional brush used in the survey of Table 4, bristles are 2 mm wide, respectively, and a distance A from a bottom to each ridge is 5.5 mm long.

According to the comparison results of Table 1 to Table 4, the most preferable mascara brush has a triangular section, ridges of 2 mm wide, a distance A from a bottom to each ridge of 5.5 mm long, and bristles of 5 mils thick.

Test

A test was performed by checking states of artificial eyelashes, after fastening human hairs to a semi-circular acryl bar of diameter 20 cm to manufacture the artificial eyelashes and making up the artificial eyelashes with various mascara brushes under the same conditions. To be specific, the test was carried out by checking respective results after combing the eyelashes in an up-down direction, then in a left-right direction three times, and thereafter in a down-up direction nine times by means of the mascara brush. The test was repeated five times to obtain an average.

(1) State Where Eyelashes are Rolled Up

| | Comparison | State where mascara is applied | State where eyelashes are rolled up (average) |
|---|---|---|---|
| Shape of brush | Circular shape | Mascara is applied up to two thirds of eyelashes. | 15 degree up |
| | Triangular shape | Mascara is applied to end portions of eyelashes. | 20 degree up |
| | Quadrangular shape | Mascara is applied up to two thirds of eyelashes. | 15 degree up |

*Bristles of the brush used in the above test are 5 mils thick, respectively, and a distance A between a bottom and each ridge of the triangular sectional brush is 5.5 mm long.

(2) State where Mascara is Clotted

| | Comparison | Eyelash aggregation (number of stuck eyelashes/number of entire eyelashes) |
|---|---|---|
| Width of ridge of triangular sectional brush | 1 mm | Some stuck (25%) |
| | 2 mm | Few stuck (10%) |
| | 3 mm | Many stuck (30%) |

*Bristles of the triangular sectional brush used in the above test are 5 mils thick, respectively, and a distance A between a bottom and each ridge is 5.5 mm long.

(3) cleanness after Making up Eyelashes

| | Comparison | Cleanness around eyes |
|---|---|---|
| Distance between bottom and ridge | 5.5 mm | No stains around eyes |
| | 8 mm | Some stains around eyes |

*In the triangular sectional brush used in the above test, bristles are 5 mils thick and ridges are 2 mm wide, respectively.

Meanwhile, in case that the distance from the bottom 12 to the ridge 11 of the mascara brush 1 ranges anywhere from 5.5 mm to 6.0 mm, it has been found that identical effects are substantially obtained.

As shown in the above tests, results of the eyelash make-up depend on the thickness of the bristles 10, the shape of the bristles 10, the width of the ridges 11, and the distance A from the bottom 12 to the ridges 11 of the brush. Further, for the Orientals having shorter eyelashes by nature, the mascara brush of the present invention is found to be the best means for making up the eyelashes in a clear and beautiful manner.

Figure 5:
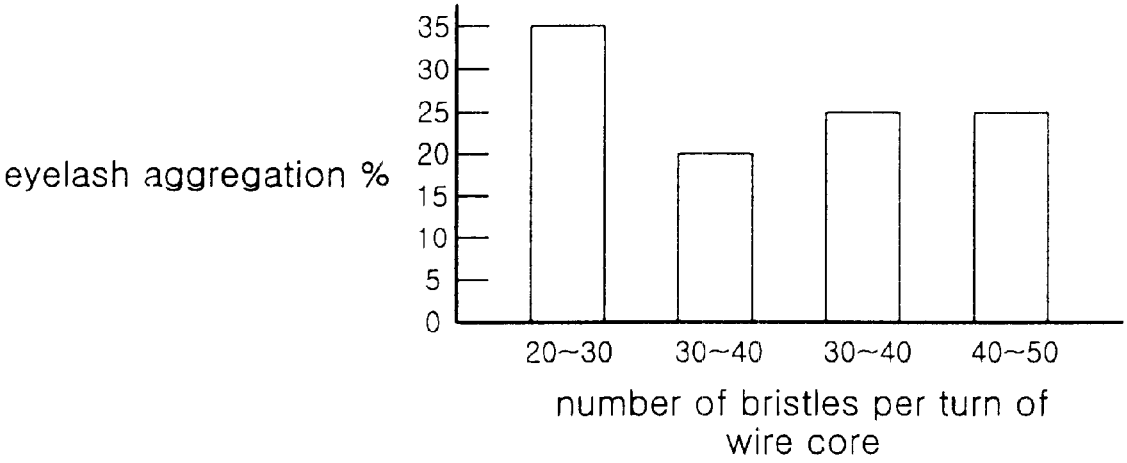
FIG. 5 is a graph showing eyelash aggregation measured according to distribution of bristles.

FIG. 5 is a graph showing eyelash aggregation measured according to the number of the bristles distributed at the wire core. As shown in FIG. 5, the eyelash aggregation depends on the number of the bristles 10 distributed at the wire core 20. The case that the bristles are placed in 30 to 40 numbers per turn of the wire core 20, in the same manner as in the present invention, is found to make the least eyelash aggregation.

Figure 6:
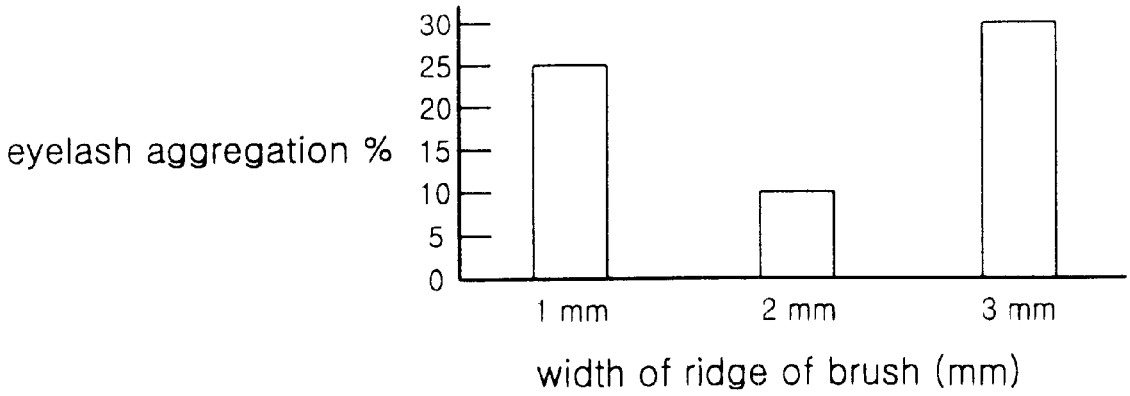
FIG. 6 is a graph showing eyelash aggregation measured according to width of ridges of the mascara brush.
Figure 7:
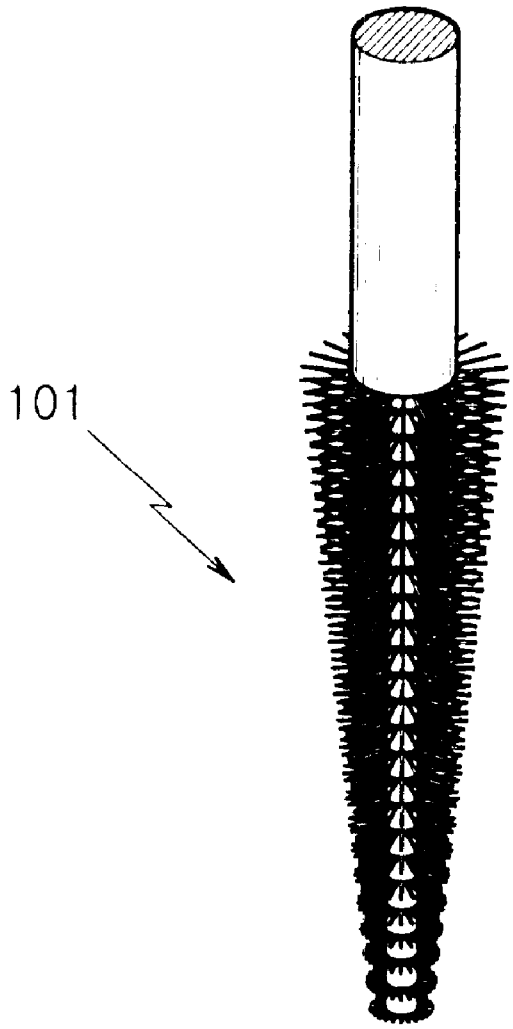
FIG. 7 is a cross view of a conventional mascara brush.
Figure 8:
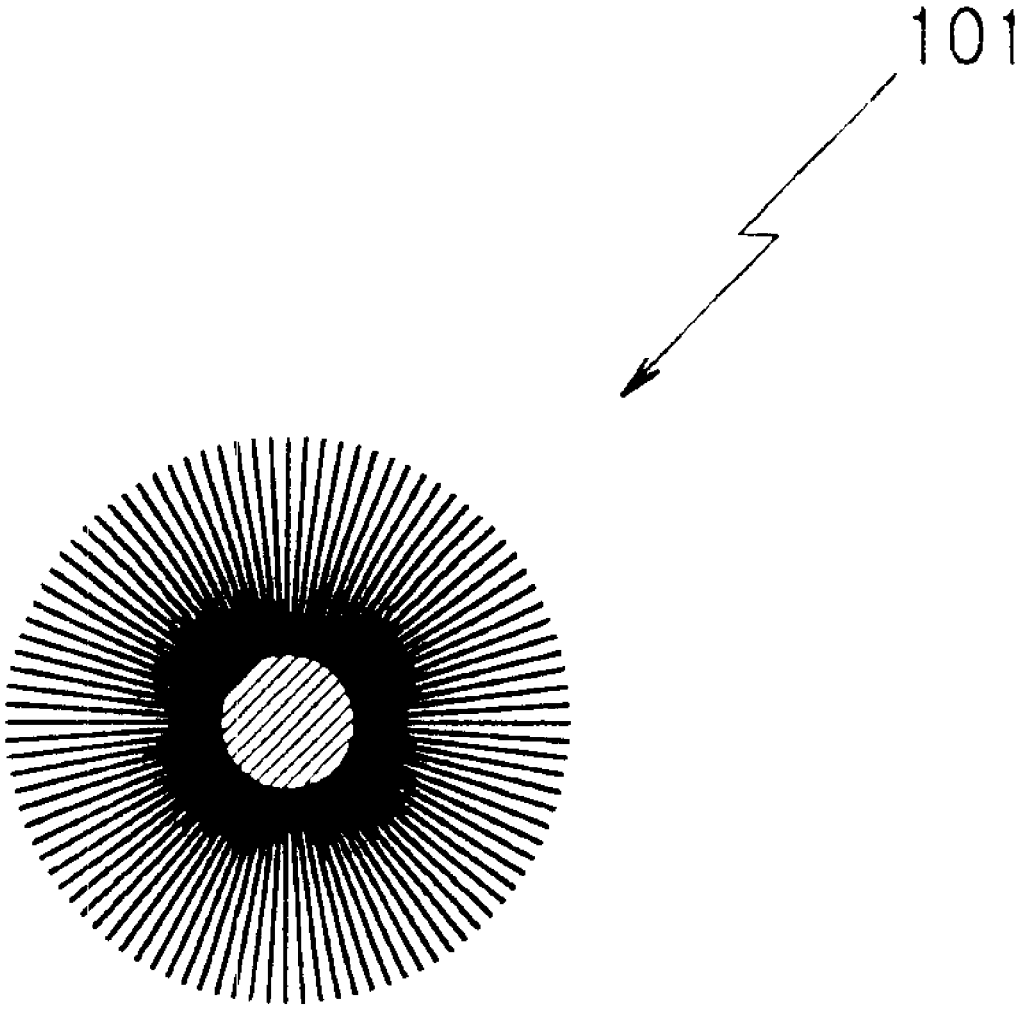
FIG. 8 is a sectional view of the conventional mascara brush of FIG. 7.

In the meantime, FIG. 6 is a graph showing eyelash aggregation measured according to the width of the ridges at the vertexes of the triangular section. As depicted in FIG. 6, the least eyelash aggregation is caused in case that the width of the ridges 11 is 2 mm as likely as in the present invention. According to the test results, as for the width of the ridges, the same effect has been obtained in the range of 1.7 mm to 2 mm.

As described above, the present invention has an advantage of reducing the troublesomeness applied to the eyes when the Orientals of the shorter eyelashes make up their eyelashes, since the mascara brush 1 of the present invention has the triangular shape in cross-section and the distance from the bottom 12 of the triangular section to the ridges 11 at the vertexes of the triangular section is in the range of 5.5 mm to 6.0 mm.

The present invention has another advantage of enabling the mascara to be uniformly applied to the eyelashes, since the bristles having the thickness of 5 mils to 6 mils are relatively thinner, and thus can go smoothly into the spaces between the respective eyelashes.

The present invention has further another advantage of permitting the shorter eyelashes to be beautifully rolled up, since the ridges 11 formed at the vertexes are in the range 1.7 mm to 2 mm wide, and hence can reduce the area on which the brush and the eyelashes are in contact with each other during combing the eyelashes.

The present invention has yet another advantage of ensuring the clean and beautiful make-up of the eyelashes with the mascara being applied in the appropriate amount and without causing the mascara aggregation, since the bottom 12 of the triangular section is formed in a straight line.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A mascara brush for making up eyelashes, comprising a spirally twisted wire core at the center thereof; and a plurality of bristles, each being fitted into the wire core at one end thereof and being outwardly extended at the other end, the bristles being 5mils to 6mils thick and distributed at the wire core to be installed in 30 to 40 numbers per turn of the spirally twisted wire core, a section of the mascara brush being of a triangular shape, ridges of 1.7 mm to 2 mm wide being formed at vertexes of the triangular section, a distance A from a bottom to each ridge of the triangular section of the mascara brush being in the range of 5.5 mm to 6 mm.

* * * * *